US006467983B2

(12) United States Patent
Fodrocy et al.

(10) Patent No.: US 6,467,983 B2
(45) Date of Patent: Oct. 22, 2002

(54) LIQUID DISPENSING APPARATUS FOR CLEANING IMPLEMENTS

(75) Inventors: Joseph John Fodrocy; Robert Bell Abrahamson; Michael David Gluhanich, all of Muskegon, MI (US)

(73) Assignee: Geerpres, Inc., Muskegon, MI (US)

( * ) Notice: Subject to any disclaimer, the term of this patent is extended or adjusted under 35 U.S.C. 154(b) by 0 days.

(21) Appl. No.: 09/754,493

(22) Filed: Jan. 4, 2001

(65) Prior Publication Data

US 2001/0006589 A1 Jul. 5, 2001

Related U.S. Application Data

(63) Continuation of application No. 09/417,189, filed on Oct. 12, 1999, now Pat. No. 6,227,744.

(51) Int. Cl.[7] ..... A46B 11/04

(52) U.S. Cl. ..... 401/279; 401/138; 401/278; 401/270

(58) Field of Search ..... 401/284, 282, 401/270, 272, 273, 278, 279, 137, 138, 139

(56) References Cited

U.S. PATENT DOCUMENTS

| | | | | |
|---|---|---|---|---|
| 371,899 A | | 10/1887 | Osborne | |
| 875,422 A | | 12/1907 | Garvey | |
| 894,359 A | | 7/1908 | Anthony | |
| 2,069,673 A | | 2/1937 | Lima | |
| 2,304,257 A | * | 12/1942 | Jilbert | 401/137 |
| 2,578,078 A | | 12/1951 | McNair et al. | |
| 2,609,557 A | * | 9/1952 | Reed | 401/137 |
| 2,893,607 A | | 7/1959 | Vosbikian et al. | |
| 3,134,129 A | * | 5/1964 | Allen | 401/137 |
| 5,469,991 A | | 11/1995 | Hämäläinen | |
| 5,933,913 A | | 8/1999 | Wright et al. | |
| 6,003,786 A | * | 12/1999 | Schwary | 239/310 |

FOREIGN PATENT DOCUMENTS

| | | |
|---|---|---|
| DE | 1104662 | 4/1961 |

* cited by examiner

*Primary Examiner*—David J. Walczak
(74) *Attorney, Agent, or Firm*—Warner Norcross & Judd LLP

(57) ABSTRACT

A liquid dispensing mechanism contained in a handle of a cleaning implement. The handle includes internal upper and lower valve assemblies sealably mounted within the handle to provide an air tight chamber therebetween for holding liquid. The upper valve assembly includes a push button actuator for introducing air into the chamber. The lower valve assembly includes a dispensing outlet for discharging the liquid from the chamber. When air is introduced into the air tight chamber through the upper valve assembly, a corresponding amount of liquid is dispensed from the chamber and out from the handle through the dispensing outlet.

13 Claims, 5 Drawing Sheets

LIQUID DISPENSING APPARATUS FOR CLEANING IMPLEMENTS

This is a continuation of application Ser. No. 09/417,189, filed Oct. 12, 1999 (now U.S. Pat. No. 6 227 744).

BACKGROUND OF THE INVENTION

The present invention relates to gravity feed liquid dispensers, and more particularly, to liquid dispensers associated with cleaning implements.

Liquid dispensers associated with cleaning implements, including mops, squeegees and brooms, are well known in the art of applying cleaning liquids, germicides and waxes to floor surfaces. Dispensers are provided as a container appended externally to the cleaning implement. For example, a liquid container may be mounted with brackets onto a mop handle. With the dispenser mounted to the mop handle, an operator may apply liquids onto a surface on which the operator is conducting cleaning tasks without re-saturating the mop by dipping the mop into a bucket or container filled with a cleaning liquid. Accordingly, the operator may conduct the cleaning task uninterrupted by frequent re-saturations, and without having to transport a bucket filled with cleaning liquids.

Typically, liquid is dispensed from handle mounted containers by the force of gravity. In U.S. Pat. No. 5,469,991 to Hämäläinen, hereby incorporated by reference, an airtight liquid holding container is connected externally to a mop handle. Liquid flows out from the appended container through a system of tubes onto a surface by its own weight. The principle of operation of the dispenser is such that when air is allowed to enter the appended external container, a corresponding amount of liquid held in the appended container is dispensed onto the surface by force of gravity.

While solving a long felt need for a liquid dispenser attached to a cleaning implement, conventional handle mounted liquid dispensers require an unwieldy container to be mounted to the handle. This inhibits movement of the handle as required to carry out various cleaning or waxing tasks. Positioning of a full liquid container at a position relatively high on the handle also makes it difficult to maneuver the cleaning implement in tight spaces. Additionally, the appended container requires bracketry to mount the container to the handle; therefore, the cost of manufacture is increased.

Further, conventional liquid dispensers use tubes to conduct and dispense liquid. These tubes are prone to kinking, plugging and blockage if anything but very viscous liquids are used therein. Along the same lines, it is difficult to remove the tubes and tubed valve assemblies from the handle to effectively perform routine cleaning of the tubing. Finally, the conventional externally mounted liquid dispensers do not easily allow the operator to select different flow rates for liquids, nor do they allow the operator to use liquids of significantly different viscosities.

SUMMARY OF THE INVENTION

The aforementioned problems are overcome in the present invention which internally integrates a liquid dispensing mechanism and a liquid retaining container or chamber within the handle of a cleaning implement. With the dispensing mechanism and chamber integrated into the handle of the cleaning implement, there is no unwieldy structure to impede an operator's movements while conducting cleaning tasks. Further, additional mounting bracketry is not required to attach an external container to the handle.

The handle of the cleaning implement generally is a tubular shaft which includes two valve assemblies; one at the top of the tubular shaft, the other at the bottom of the tubular shaft. Both valve assemblies include seals to create an air tight chamber within the tube. Accordingly, when the chamber has liquid in it, the liquid cannot escape onto the surface to be cleaned until air is introduced into the chamber. The top valve assembly includes a push button mechanism to allow air into the air tight chamber. By introducing air, an equal amount of liquid is dispensed out from the handle through the lower valve assembly.

In a second aspect of the invention, the unique structure of the upper and lower valve assemblies eliminates the need for extensive plastic tubing which is prone to kinking or blockage. In a third aspect of the invention, the entire air/hydraulic valve system is removably disposed in the handle of the cleaning implement and generally includes only two valves. This valve system may be easily pulled manually from the tubular handle to perform routine cleaning or repair of the internal components of the dispensing mechanism. In a fourth aspect of the invention, a unique end connector for connecting the handle to various cleaning attachments, such as different mop heads, is coupled to the handle below the lower valve assembly. This end connector is compatible with various discharge nozzles that can accommodate different flow rates of liquid and different liquid viscosities. Accordingly, the same end connector can be used for multiple liquids and rates of flow merely by changing the discharge nozzle.

These and other objects, advantages, and features of the invention will be more readily understood and appreciated with reference to the detailed description of the preferred embodiment and drawings.

DETAILED DESCRIPTION OF THE PREFERRED EMBODIMENT

Figure 1:
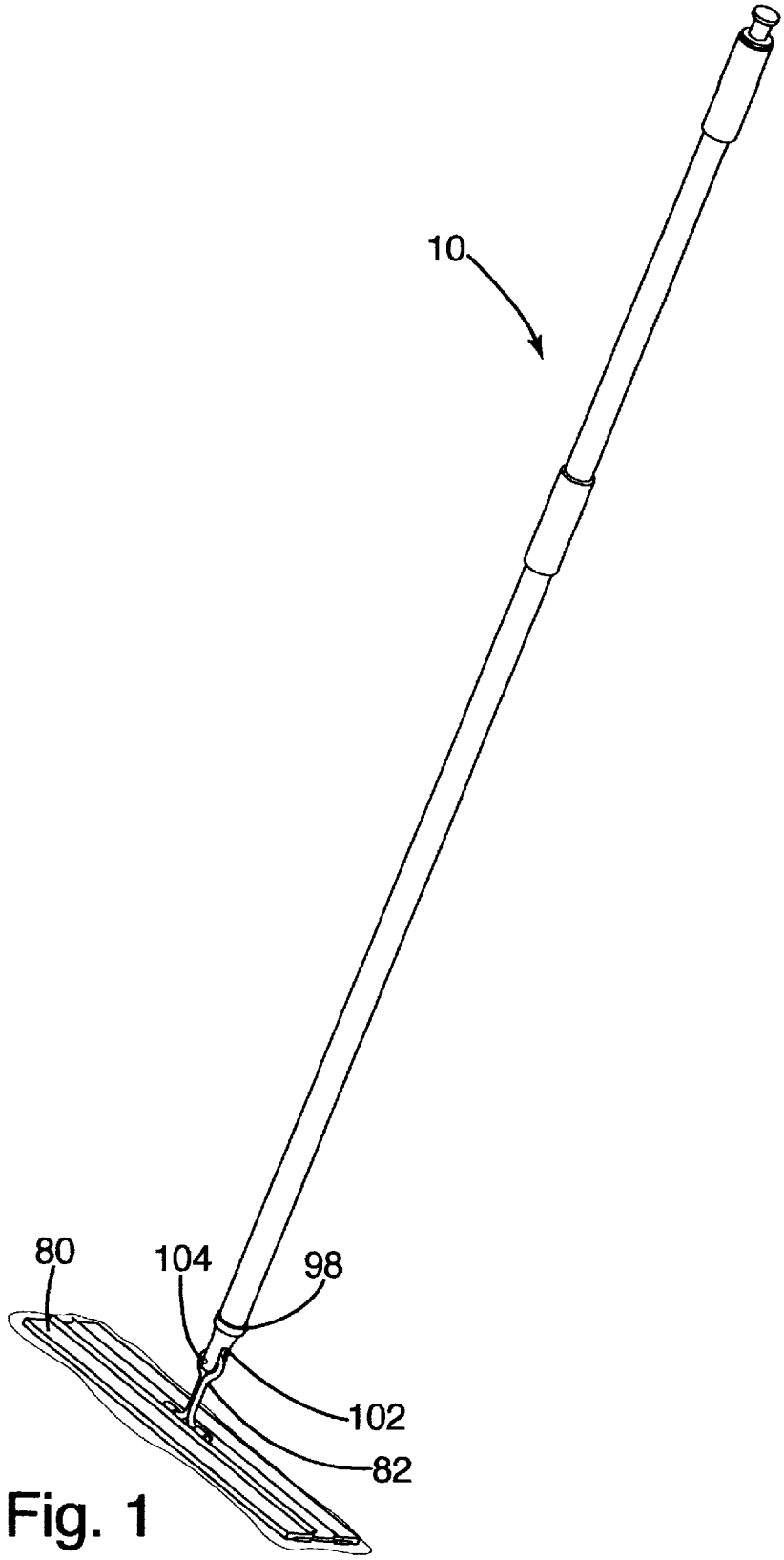
FIG. 1 is a perspective view of a liquid dispensing apparatus of the type used in the present invention with a cleaning attachment mounted thereto.
Figure 2:
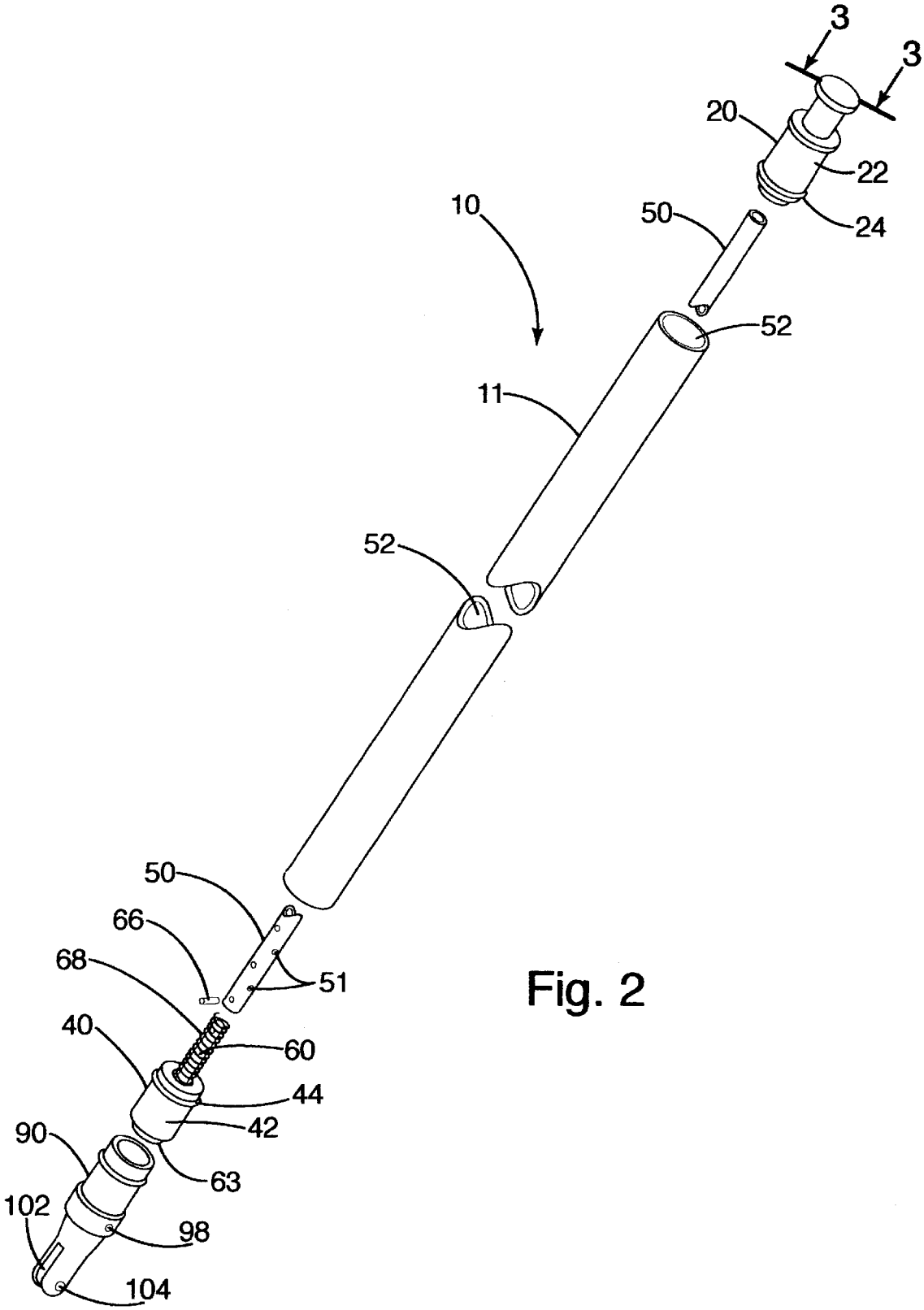
FIG. 2 is an exploded view of the internal components of the apparatus.

A preferred embodiment of the liquid dispensing apparatus of the present invention is illustrated in FIGS. 1 and 2 and generally designated 10. FIG. 1 depicts the dispensing handle as it would be configured while conducting a cleaning task. Dispensing handle 10 is coupled to a flat mop head 80. Liquid is dispensed directly from the dispensing outlet 98 as depicted.

With reference to FIG. 2, the internal components of the dispensing handle generally include an upper valve assembly 20, a push rod 50, a lower valve assembly 40, and an end connector 90. Preferably, all components are made from non-corrosive, rigid materials such as plastic, stainless steel or an anodized aluminum alloy, or any combination thereof.

Figure 3:
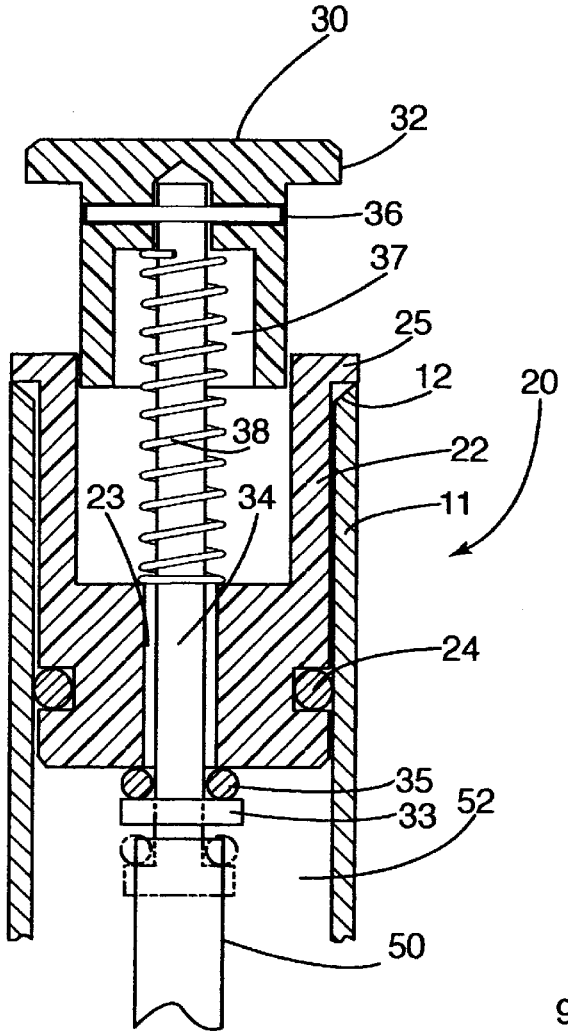
FIG. 3 is a sectional view of the apparatus taken along line 3—3 of FIG. 2.

As can be seen in FIGS. 2 and 3, the upper valve assembly 20 includes a cylindrical upper valve body 22 that fits closely into a tubular shaft 11. This upper valve body is preferably manually removable from the tubular shaft 11 to facilitate filling of chamber 52 with liquid, and cleaning of the valve assemblies, but may also be fixedly attached the tubular shaft 11 as long as alternative filling orifices (not shown) are provided in the tubular shaft to allow liquid to be injected into chamber 52. O-ring 24 creates an air tight seal between the upper valve body 22 and the tubular shaft 11. Lip 25 abuts and seats against an edge 12 of the tubular shaft at the upper portion of the tubular shaft 11. Edge 12 is preferably beveled to facilitate filling of the tubular shaft 11 with liquid. The upper valve body 22 includes an internal bore in which a push button assembly 30 is longitudinally disposed.

The push button assembly 30 includes push button 32 and valve stem 34, connectively attached to push button 32 with pin 36. Alternatively, the push button 32 and valve stem 34 may be connected by adhesives, screws or other fasteners, or formed from a single piece. Push button 32 also may be solid rather than as depicted including an internal longitudinal bore 37. Bias element 38, preferably a coil spring, encircles valve stem 34 and provides bias between the upper valve body 22 and the push button 32 within the internal longitudinal bore 37. The bias element may be a helical or leaf spring, elastomer, or any other material suitable for biasing push button 32 relative to the upper valve body 22 while resisting corrosion due to liquids used in the dispensing handle 10.

Upper valve stem 34 fits through upper valve body passageway 23, and extends below the upper valve body 22. At the lower most portion of the upper valve stem 34 is lip 33. O-ring 35 is disposed on, or at least in close proximity to, lip 33. In storage mode (shown in solid lines), O-ring 35 seats tightly between lip 33 and the lower portion of the upper valve body 22 so that fluids (liquid or air) cannot pass through passageway 23. In dispensing mode (shown in broken lines) upper valve stem 34 is displaced downward to break the seal between lip 33 and the lower portion of upper valve body 22. In an alternative embodiment, the lower portion of the upper valve body 22 may be beveled (not shown) to facilitate seating of the O-ring 35 against the upper valve body 22. Notably, any sealing mechanism may be used in place of O-ring 35 to create an airtight seal between the lower portion of the upper valve body 22 and lip 33.

Figure 4:
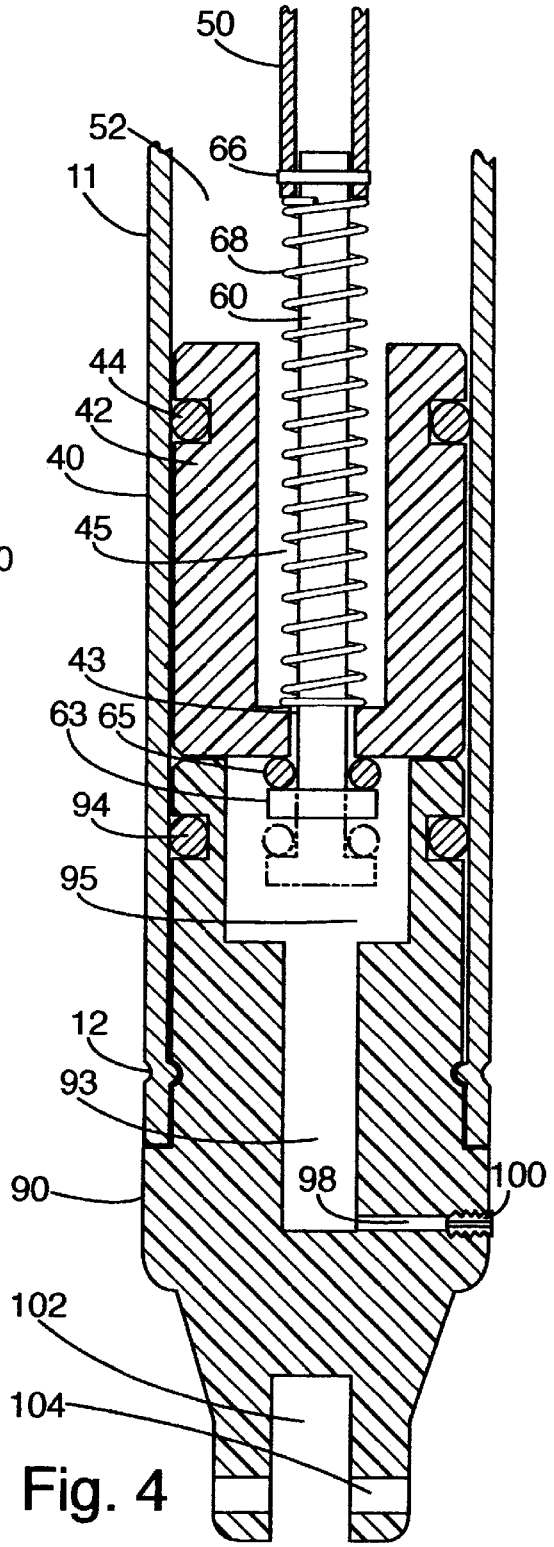
FIG. 4 is a sectional view of the apparatus taken along line 3—3 of FIG. 2.

As illustrated in FIGS. 2, 3 and 4, push rod 50 is preferably a hollow tubular shaft to promote weight savings for the dispensing handle. Disposed at the lower end of the push rod 50 are radial holes 51 which provide drainage outlets for liquid that would otherwise become trapped in the push rod 50 if the dispensing handle was in a substantially vertical position. Push rod 50 extends from immediately below the upper valve assembly 20 to immediately above the lower valve assembly 40. Notably, the push rod 50 does not abut directly against upper valve stem lip 33 in storage mode. Because of this, the dispensing handle 10 may be oriented substantially horizontally without allowing any fluid to leak out from chamber 52 through upper valve body passageway 23.

As illustrated in the preferred embodiment of FIG. 4, the push rod 50 receives in its internal bore the lower valve stem 60. Lower valve stem 60 is attached to push rod 50 by pin 66. Alternatively, a screw, adhesive or the like may be used in place of pin 62 to attach push rod 50 to lower valve stem 60. Lower valve stem 60 extends from push rod 50 through internal bore 45 of lower valve body 42, and through passageway 43, to below lower valve body 42, where the lower valve stem 60 terminates at lower lip 63. In an alternative embodiment, the lower valve stem may be of reduced diameter, or include valleys, in the portion surrounded by passageway 43 to improve the flow of liquid through the passageway 43 between the lower valve body 42 and the lower valve stem 60.

In the preferred embodiment, bias element 68 encircles valve stem 60 and provides bias between push rod 50 and lower valve body 42. O-ring 65 is disposed on, or at least in close proximity to lower lip 63. In storage mode (shown in solid lines) O-ring 65 seats tightly between lower lip 63 and the lower portion of the lower valve body 42 so that fluid cannot pass through passageway 43. Notably, any sealing mechanism may be used in place of the O-ring to create an air tight seal between the lower portion of lower valve body 42 and lip 63. In an alternative embodiment, the lower portion of the lower valve body 42 around the passageway 43 may be beveled to facilitate seating of the O-ring 65 against the valve body 42. In dispensing mode (shown in broken lines) lower valve stem 60 is displaced downward to break the seal between lower lip 63 and lower valve body 42.

As depicted in FIGS. 2 and 4, the lower valve body 42 is sealably displaced in tubular shaft 11. O-ring 44 creates an air tight seal between lower valve body 42 and tubular shaft 11. Any sealing mechanism may be used in place of O-rings 24 and 44 that creates an air tight seal between lower valve body 42 and tubular shaft 11. Further, any number of O-rings in addition to those depicted may be used, depending on the application.

In the preferred embodiment, the lower portion of the lower valve body 42 abuts end connector 90. In an alternative embodiment, the lower portion of lower valve body 42 may include a valve seat (not shown) which couples directly to an internal annular bore (not shown) of end connector 90. In the preferred embodiment as depicted in FIGS. 2 and 4, end connector 90 is cylindrical and sealably fits inside tubular shaft 11. The end connector 90 is fixed to the tubular shaft by way of detents 12. Other means of attachment, such as fasteners or adhesives, are readily appreciated by those skilled in the art. O-ring 94 creates an air tight seal between tubular shaft 11 and end connector 90. End connector 90 includes a first internal bore 95, in which lip 63 and lower valve stem 60 may longitudinally traverse, and a second internal bore 93.

At the lower most portion of the second internal bore 93, discharge outlet 98 extends radially outward. Discharge outlet is threaded so that it can receive outlet nozzle 100. In an alternative embodiment, discharge outlet 98 is not threaded and therefore cannot receive any outlet nozzle. In the preferred embodiment, because the discharge outlet is threaded, it can accept a variety of different sized and shaped nozzles to accommodate various flow rates of fluid, as well as fluids of different viscosities being dispensed.

End connector 90 is outfitted with yoke slot 102, and bolt hole 104. As depicted in FIGS. 1 and 4, yoke 82 is received in yoke slot 102, with bolt 104 positioned through the yoke to secure the mop head 80 to the dispensing handle 10. Other end connectors will be readily appreciated by those skilled in the art that would sufficiently connect mop head 80 to dispensing handle 10. Other cleaning implements such as a string mop, a squeegee, and a broom may be substituted for the flat mop head 80 as will be appreciated by those skilled in the art.

Figure 5:
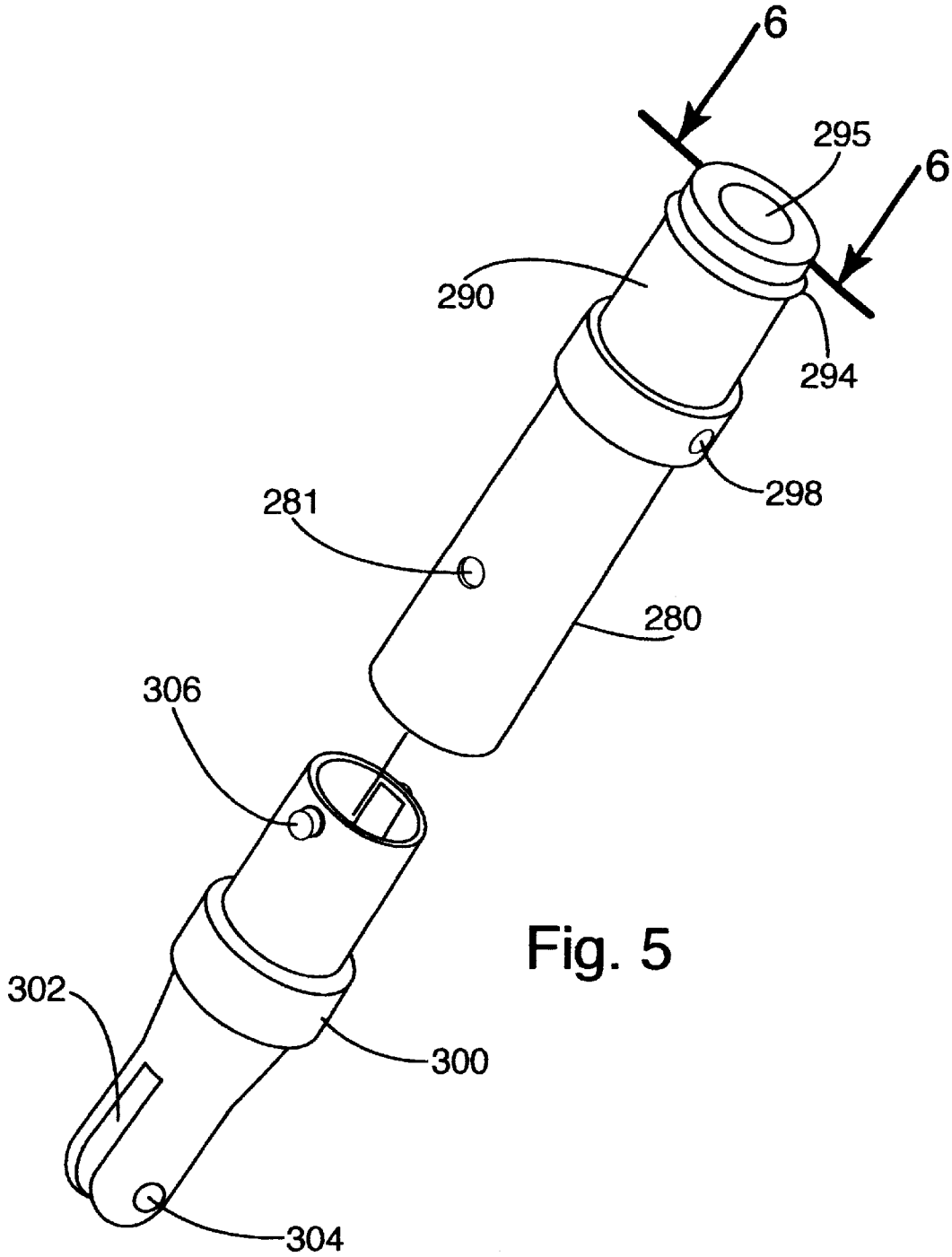
FIG. 5 is an alternative embodiment of the internal components and attachments of the apparatus; and, FIG. 6 is a sectional view of the apparatus taken along line 6—6 of FIG. 5.
Figure 6:
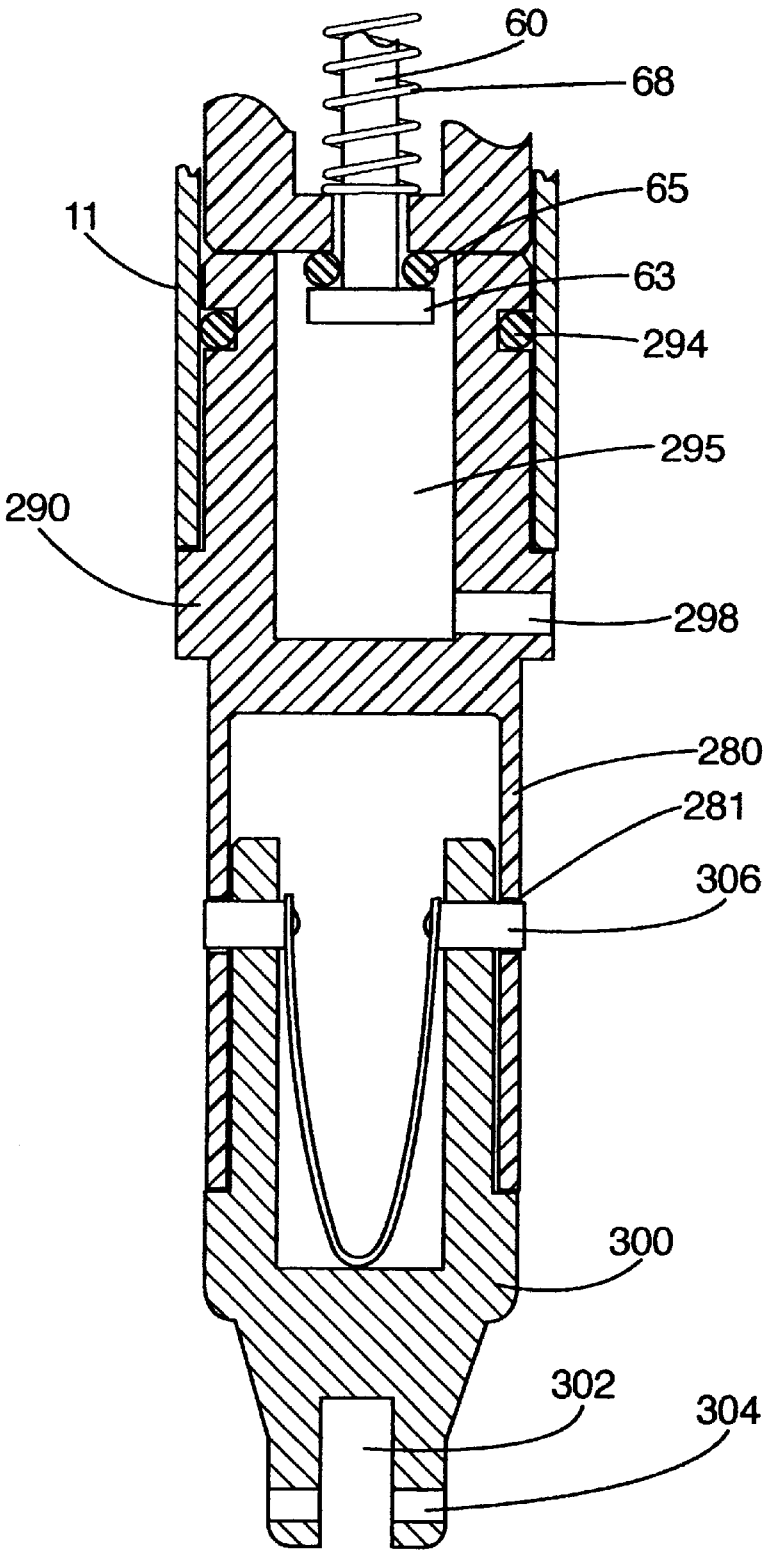

In an alternative embodiment, as depicted in FIGS. 5 and 6, the end connector 290 is configured to attach to an autoclavable mounting connector 300. End connector 290 mounts and seals with O-ring 294 in tubular shaft 11 in the manner described above in the preferred embodiment. Notably, the discharge outlet 298 of the alternative embodiment may be threaded to receive a variety of different nozzles as described above.

End connector 290 includes receiver shaft 280. Receiver shaft 280 defines holes 281. Holes 281 are positioned to receive tongs 306 and attach mounting connector 300 to the end connector 290. Many other means for releasably attaching receiver shaft 280 to mounting connector 300 will be readily appreciated by those in the art. Mounting connector includes yoke slot 302 and bolt hole 304, which may be used in the same manner as described above in the preferred embodiment to attach various cleaning attachments thereto.

Operation

The main principle of operation of the preferred embodiment shown in FIGS. 2, 3 and 4 is that when air enters the chamber 52, though upper valve assembly 20 by depressing the button assembly 30, a corresponding amount of liquid held in chamber 52 is discharged through the lower valve assembly 40, out through discharge outlet 98, and onto a surface being cleaned. Liquid will tend to flow out of the chamber by gravity, but the liquid is not discharged from the chamber unless an equal amount of air replaces it.

The dispensing handle generally has two modes in which it may be used; storage mode, and dispensing mode. In storage mode, liquid is retained in tubular shaft 11, sealed between valve assemblies 20 and 40 by way of associated O-rings 24 and 44.

As seen in FIGS. 3 and 4, in storage mode (shown in solid lines) spring 38 provides bias to force upper valve stem 34, lip 33, and associated O-ring 35 upward, to form a fluid tight seal between O-ring 35 and the lower portion of upper valve body 22. In this manner, no air is allowed to enter chamber 52 through internal passageway 23. Accordingly, no liquid may be displaced from chamber 52.

In storage mode, push rod 50 is displaced near upper valve stem 34, but not immediately abutting the valve stem 34. However, push rod 50 is contacted when the push button assembly is fully depressed in dispensing mode, as described below. Push rod 50 does not abut valve stem 34 so that should push button assembly 30 be accidentally partially depressed, push rod 50 will not activate lower valve assembly 40 to dispense fluid from the dispensing handle.

In storage mode (shown in solid lines) as depicted in FIGS. 3 and 4, the lower valve assembly prevents liquid from being emptied from chamber 52. Spring 68 provides an upward force against push rod 50, and consequently lower valve stem 60. Accordingly, O-ring 65 seals itself between the lower portion of lower valve body 42 and lip 63, effectively sealing off passageway 43 so that no liquid may flow there through and into internal bore 95.

In storage mode with both upper and lower valve assemblies 20 and 40 acting in concert, liquid cannot escape internal chamber 52.

Now there will be described the manner in which liquid is dispensed from the dispensing handle 11.

In dispensing mode, air is allowed to enter into the internal chamber 52 through upper valve assembly 20, and a corresponding amount of liquid is dispensed through lower valve assembly 40.

As depicted in FIGS. 2, 3 and 4, to initiate the dispensing mode, push button 32 is manually depressed by an operator. During initial depression, spring 38 is compressed, the airtight seal created by O-ring 35 between the lower portion of upper valve body 22 and lip 33 is broken, allowing air to enter into internal chamber 52 through internal passageway 23. As depicted in FIG. 3 in broken lines, after the push button 32 has been depressed halfway through its stroke, it engages push rod 50. Upon further depression, push rod 50 is also forced downward. When push rod 50 moves downward, it compresses spring 68, and simultaneously moves lower valve stem 60 downward. Consequently, the air tight seal created by O-ring 65 between the lower portion of lower valve body 42 and lip 63 is broken, allowing liquid to empty from internal chamber 52, through passageway 43, through first internal bore 95, through second internal bore 93, and out discharge outlet 98 into the environment. As discussed above, discharge nozzle 100 may be of varying configurations to provide different dispensing patterns or flow rates to allow fluids of different viscosities to be dispensed. To change the nozzle 100, nozzle 100 is simply unscrewed from the threads and replaced with another nozzle suitable for the given application.

Dispensing of fluid out from chamber 52 into the environment will continue until the chamber is empty while push button 32 is fully depressed by the operator. To cease dispensing and return the dispensing handle to storage mode the operator must discontinue depressing push button 32. When depression is discontinued, spring 68 moves lower valve stem 60 and lip 63 upward so that fluid tight seal is formed by the O-ring 65 pressed against the lower portion of the lower valve body 42. Accordingly, liquid can no longer escape from internal chamber 52 through now-sealed passageway 43.

Similarly when the operator discontinues depression of push button 32 as depicted in FIG. 3, spring 38 moves upper valve stem 34 upward so that O-ring 35 forms an air tight seal between lip 33 and the lower portion of the upper valve body 22, effectively sealing off passageway 23 so that air can no longer enter into internal chamber 52. The operator may dispense liquid in a variety of volumes depending on how long the push button 32 is fully depressed to allow liquid to escape by gravity from the internal chamber 52.

Notably, the above described structure of the dispensing handle 11 also facilitates filling and routine cleaning of the dispensing mechanisms. To fill the tubular shaft 11, that is, internal chamber 52, the operator must grasp the upper valve assembly 20 by lip 25 and pull it out from tubular shaft 11. Liquid may then be poured into the tubular shaft 11. Beveled edge 12 facilitates such pouring. After the tubular shaft is filled, the operator may replace the upper valve assembly 20 back in tubular shaft 11.

Routine cleaning/inspection of the valve assemblies is performed in a similar manner. The operator removes upper valve assembly 20 as described above. The operator may then grasp push rod 50 with his or her fingers, or a pinching tool if necessary. Pulling the push rod 50, outward from the tubular shaft 11, will consequently pull lower valve assembly 40 out from the shaft because the push rod 50 and the lower valve body 42 are interconnected by the lip 63 of the lower valve stem.

After the upper and lower valve assemblies have been inspected and cleaned, the operator may replace the lower valve assembly 40 back into the tubular shaft 11, and push it into the tubular shaft 11 with the push rod 50, until it abuts end connector 90. Notably, the beveled edge 12 facilitates inserting the O-ring sealed valve assemblies into the tubular shaft 11.

Once the lower valve assembly 40, and push rod 50 have been replaced in the tubular shaft, the upper valve assembly 20 may be replaced as well.

The above description is that of a preferred embodiment of the invention. Various alterations and changes can be made without departing from the spirit and broader aspects of the invention as defined in the appended claims. Further, any reference to claim elements in the singular, for example, using the articles "a," "and," "the," or "said," is not to be construed as limiting the element to the singular. The claims are to be interpreted in accordance with the principles of patent law including the doctrine of equivalents.

What is claimed is:

1. A liquid dispensing handle for a cleaning implement chosen from a mop, a squeegee, and a broom comprising:

a tubular shaft defining an internal chamber and including a top portion and a bottom portion;

means for connecting the floor cleaning implement to said bottom portion;

an upper valve assembly sealably disposed in said top portion;

means for actuating said upper valve assembly to allow air into said tubular shaft coupled to said upper valve assembly;

a rod longitudinally disposed in said tubular shaft, said rod defining an internal rod chamber, and including a bottom portion, said bottom portion defining holes; and a lower valve assembly sealably disposed in said bottom portion including an assembly outlet that allows a liquid to pass out from said internal chamber directly onto a surface to be cleaned when said actuating means is manually activated by a user.

2. The liquid dispensing handle of claim 1 wherein the internal chamber defined by said tubular shaft retains one chosen from a cleaner, a wax and a germicide in said tubular shaft.

3. The liquid dispensing handle of claim 2 wherein said upper valve assembly includes a depressible push button coupled to a valve stem seal, whereby depression of said push button allows air to enter into said internal chamber.

4. A handle for a floor cleaning implement chosen from a mop, a squeegee, and a broom, comprising:

a tubular shaft including an upper portion and a lower portion;

a first valve displaced in said upper portion including means for submitting air into said tublar shaft;

a second valve displaced in said lower portion whereby an air tight chamber is created between said first valve and said second valve in said tubular shaft; and a dispensing outlet proximal to said second valve for dispensing one chosen from a cleaner, a wax, and a germicide from said air tight chamber directly onto a surface to be cleaned, waxed or germicidally treated, wherein said dispensing outlet includes a receiving port for interchangeably accepting discharge nozzles capable of dispensing different types of liquids and dispensing liquids at different flow rates.

5. The handle of claim 4 wherein said first valve assembly includes at least one first seal which engages said tubular shaft to prevent air from leaking past said seal.

6. The handle of claim 4 wherein said second valve assembly includes at least one second seal which engages said tubular shaft to prevent liquid from leaking past said seal.

7. The handle of claim 6 wherein said first and second seals are O-rings.

8. The handle of claim 7 further comprising an internal shaft disposed longitudinally in said tubular shaft and coupled to said second valve assembly.

9. The handle of claim 8 wherein said submitting means is capable of being actuated to one of a storage mode, whereby liquid is retained in said air tight chamber, and a dispensing mode, whereby air is permitted to enter into said air tight chamber and liquid is consequently dispensed from said air tight chamber.

10. The handle of claim 9 wherein said submitting means includes a bias element capable of returning said submitting means to said storage mode from said dispensing mode.

11. The handle of claim 10 further comprising an autoclavable end connector for attaching different types of cleaning head elements to said handle.

12. The handle of claim 11 wherein said first valve is removable from said internal upper portion of said tubular shaft whereby liquid may be poured into said tubular shaft.

13. A liquid dispensing mop handle comprising:

a container including a first portion, a second portion, and an internal chamber;

a first valve assembly located in said first portion in said internal chamber, said valve assembly capable of submitting air into said internal chamber;

a second valve assembly disposed in said second portion in said internal chamber, capable of cooperating with said first valve assembly to dispense one chosen from a cleaner, a wax and a germicide retained in said internal chamber directly onto a surface to be cleaned, waxed or germicidally treated; and an outlet disposed in at least one of said second value assembly and said container, said outlet capable of accepting discharge nozzles that dispense liquids at different rates.

* * * * *